United States Patent [19]

Willson

[11] Patent Number: 4,608,812

[45] Date of Patent: Sep. 2, 1986

[54] YOUTH STIRRUP ACCESSORY

[76] Inventor: Edwin G. Willson, Star Route #2, Box 236, Cave Creek, Ariz. 85331

[21] Appl. No.: 733,041

[22] Filed: May 13, 1985

[51] Int. Cl.[4] ..... B68C 1/16

[52] U.S. Cl. ..... 54/44; 54/46

[58] Field of Search ..... 54/44, 46, 47

[56] References Cited

U.S. PATENT DOCUMENTS

| | | | |
|---|---|---|---|
| 425,184 | 4/1890 | Padgitt | 54/46 |
| 2,830,420 | 4/1958 | Smith | 54/46 |
| 3,112,592 | 12/1963 | Schindler | 54/44 |
| 3,234,710 | 2/1966 | Gauthier | 54/44 |
| 3,266,218 | 8/1966 | Pentz | 54/44 |
| 3,812,650 | 5/1974 | Dabney | 54/47 |
| 3,916,604 | 11/1975 | Phipps | 54/44 |
| 4,164,834 | 8/1979 | Christensen | 54/46 |
| 4,362,003 | 12/1982 | Robinson | 54/44 |

*Primary Examiner*—Hugh R. Chamblee

*Attorney, Agent, or Firm*—LaValle D. Ptak

[57] ABSTRACT

An auxiliary stirrup assembly is provided to permit small children to ride on a standard saddle which otherwise is too large for them. The stirrup assembly includes a strap which is attached to the pommel of the saddle and extends along each side of the seat to circle behind the cantle of the saddle, leaving the seat free of any encumbrances. Auxiliary stirrups are attached by means of adjustable length stirrup straps to each side of the seat-encircling strap to complete the stirrup assembly. The child rides using the stirrups of the auxiliary stirrup assembly which hang down alongside the fenders of the standard full-sized saddle on which the auxiliary stirrup assembly is mounted.

13 Claims, 4 Drawing Figures

YOUTH STIRRUP ACCESSORY

BACKGROUND

Horseback riding is becoming increasingly popular in the United States. Riding clubs and horse shows for competitive riding of a variety of different types may be found in all parts of the country. Part of the popularity of horseback riding is due to the fact that it can be enjoyed by persons of various ages and having a relatively wide range of physical abilities. Horseback riding also is enjoyed by both men and women and constitutes a wholesome family activity involving both parents and children.

Children may be taught to ride horses at very young ages and readily acquire the skills necessary for horseback riding. For small children (for example, from ages 2 through 7) a serious limitation to the development of horseback riding skills is the unavailability of small-size saddles and stirrups for use by such children. So-called "youth" saddles do exist. These are simply scaled-down versions of full size saddles but, as a child grows, the child quickly outgrows youth saddles; so that they continually must be replaced and repurchased. This is expensive, and such saddles for very young riders of small stature (for example, from 2 to 4 years old) are not readily available.

Various approaches have been taken to provide a means by which a young rider can enjoy the sport of horseback riding without requiring the construction of scaled-down versions of conventional adult-sized saddles for use by the child. One approach is illustrated in the patent to Schindler, U.S. Pat. No. 3,112,592. This patent discloses the addition of a complete "piggyback saddle" which is attached over the standard adult saddle so that a child may ride the horse. This piggyback saddle has straps on its front and rear for attachment to the pommel and cantle of the adult saddle. Stirrups are attached to the piggyback saddle by means of small fenders which overlie the fenders of the adult saddle. In this approach, the adult saddle is the saddle which is attached to the horse by means of the conventional girth strap. This device, however, is relatively expensive since the piggyback saddle involves a number of conventional saddle construction features. In addition, the problems of a child outgrowing a saddle of a particular size are present in Schindler since it still is a saddle which, in any given size, may be quickly outgrown by the rider. The primary difference between the Schindler piggyback saddle and standard youth saddles (which are made to be placed directly on the horse) is that instead of being attached to the horse, the Schindler saddle is made to piggyback on a regular saddle.

A different approach to providing a way for small children to ride a horse is disclosed in the Christensen Patent, U.S. Pat. No. 4,164,834. This patent is directed to an auxiliary stirrup attachment comprising a strap which stretches over the top of the seat of the conventional adult saddle. Stirrups are attached to each end of this strap and the strap itself is attached at its center through a further strap (or pair of straps) to the pommel of the saddle. The intent of Christensen is for an adult rider to be seated in normal position on the adult saddle which is attached to the horse. A child then is seated in front of the adult, and the auxiliary stirrups are available for the feet of the child who is riding in tandum with the adult behind him. There is nothing to prevent the stirrups of the auxiliary stirrup strap from sliding forward or from shifting substantially side-to-side across the seat of the saddle on which this auxiliary stirrup attachment is placed. The device is not intended for use by a child riding alone without an adult in tandum and does not provide a secure set of stirrups for use by the child.

Other patents have attempted to solve the problem by mounting a complete scaled-down miniature saddle on top of the pommel of a conventional adult saddle. Patents directed to this type of "piggy-back" saddle are Phipps, U.S. Pat. No. 3,916,604; Pentz, U.S. Pat. No. 3,266,218; and Gauthier, U.S. Pat. No. 3,234,710. All of these patents disclose little miniature saddles which are mounted on top of the pommel of a conventional adult western saddle. These miniature saddles are made to hold a very young rider in front of an adult rider who is also riding the horse at the same time. The child and adult ride in tandum, much as with the arrangement of the Christensen patent. The positioning of the miniature saddle, however, is unnatural and the problems of securely fastening the miniature saddle on the relatively small surface of the pommel make it difficult to have a stable mounting for the miniature saddle. The miniature pommel saddles of these patents are not intended for use by child riders who are riding the horse alone. The child rider must be accompanied on the horse by an adult.

Another auxiliary saddle arrangement is disclosed in the patent to Robinson, U.S. Pat. No. 4,362,003. This patent is directed to a small auxiliary child's saddle which is mounted on the horse directly behind the conventional adult saddle. This small saddle is attached to the adult saddle to hold it in place directly behind the cantle of the adult saddle. Again, the intention of the saddle disclosed in Robinson is to provide a place for a small child to ride in tandum with an adult who is seated on a conventional saddle.

It is desirable to provide a means for small children to ride a horse without being accompanied by an adult and without requiring a miniature scaled-down saddle (which will have limited utility as the child grows) for accomplishing the purpose. It is desirable to provide an inexpensive, auxiliary stirrups, capable of adjustment as the child grows, which is easy to use and inexpensive to manufacture.

SUMMARY OF THE INVENTION

It is an object of this invention to provide a means for very young children to ride horses.

It is a further object of this invention to provide an auxiliary stirrup assembly for use in riding horses by young children.

It is another object of this invention to provide an auxiliary stirrup assembly for use by young children to ride horses in which the stirrup assembly is attached to a conventional adult saddle.

It is a further object of this invention to provide an auxiliary stirrup assembly for use in conjunction with a conventional saddle, so that small children may ride horses without being accompanied by an adult and in which the stirrup assembly is readily adjustable to accommodate riders of various sizes.

In accordance with the preferred embodiment of this invention, an auxiliary stirrup assembly is made for use with a conventional adult saddle having a seat, cantle and pommel. A strap is provided to encircle the seat of the saddle and is attached between the pommel and the cantle of the saddle. Auxiliary stirrups are attached to the strap on each side of the seat of the saddle so that a child may sit on the seat and use the auxiliary stirrups. The stirrups themselves are attached by means of adjustable straps so that the distance between the stirrup and the point of attachment to the saddle seat encircling strap may be varied to accommodate children to different sizes or for adjustment as a child grows, up until the point the child is capable of riding in a conventional saddle without the auxiliary stirrup assembly.

DETAILED DESCRIPTION

Figure 1:
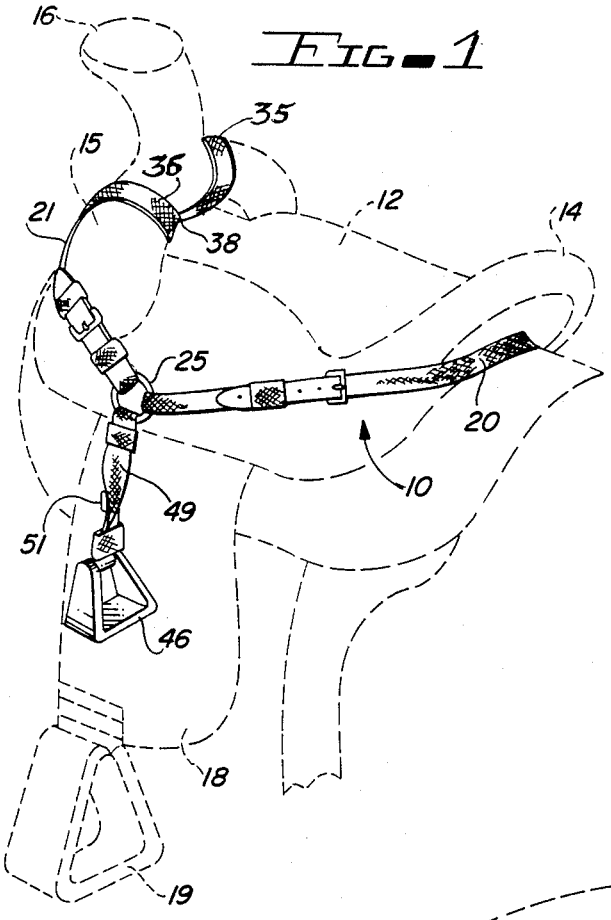
FIG. 1 is a rear perspective view of a preferred embodiment of the invention illustrating its manner of use.
Figure 2:
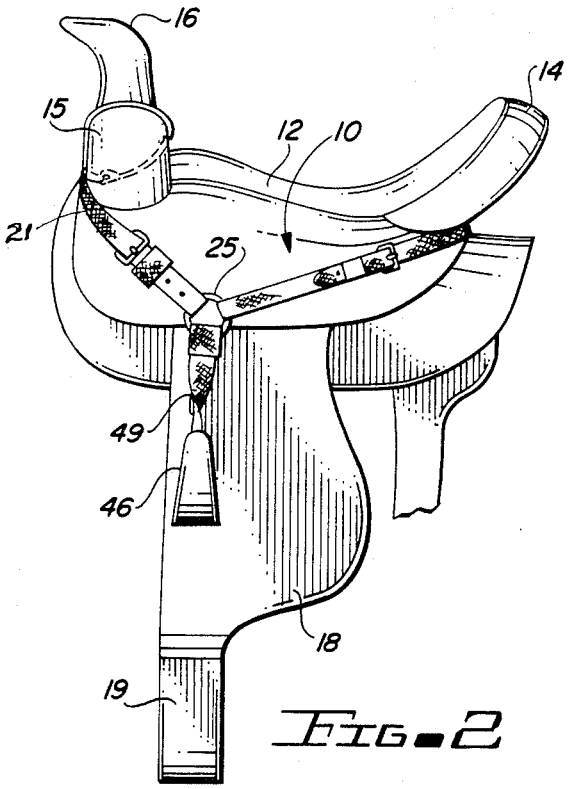
FIG. 2 is a side view of the embodiment shown in FIGS. 1 illustrating the position of the device on a saddle.
Figure 3:
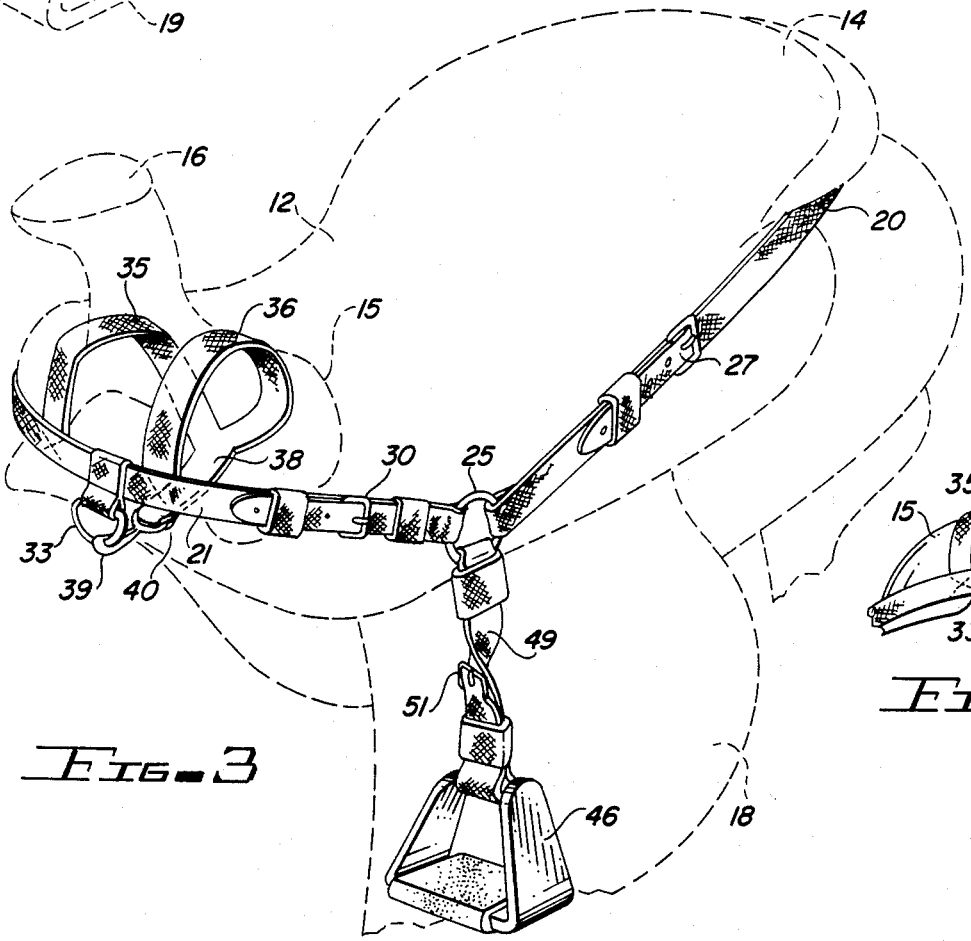
FIG. 3 is an enlarged front perspective view of the embodiment of the invention shown in FIG. 1 and 2.
Figure 4:
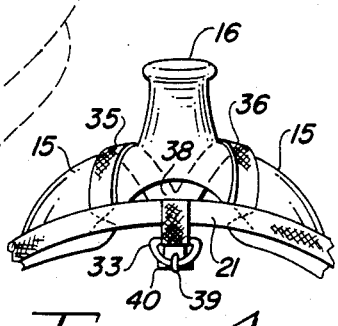
FIG. 4 is a front view illustrating further details of the embodiment.

Reference now should be made to the drawing in which the same or similar components have the same reference numbers in the various figures. FIGS. 1 and 3 illustrate rear perspective and front perspective views, respectively, of a preferred embodiment of the invention. In both of these views, a standard western saddle 10 is illustrated in dotted lines to show the manner in which the auxiliary youth stirrup assembly is attached to such a saddle. The conventional western saddle includes a seat 12 with a cantle 14 at the rear and a pommel 15 terminating in a horn 16 at the front. A pair of downwardly depending fenders 18 are attached to each side of the saddle and a pair of stirrups 19 are attached to the bottom of the fenders 18. The saddle 10 then is secured to a horse in a conventional manner.

To permit a young or very small rider to ride a horse without requiring the purchase of a specialized, expensive miniature saddle, the stirrup assembly accessory which is illustrated in FIGS. 1, 2, 3 and 4 of the drawing has been developed. This stirrup assembly comprises a pair of primary saddle-encircling straps 20 and 21 for encircling the rear and front portions respectively of the seat 12 of the saddle 10. These straps are interconnected together by a pair of circular connecting rings 25, one on each side. The assembly is symmetrial, (i.e., the same on both sides), so only the left side has been shown to avoid cluttering the drawing. The rear strap 20 is adjustable in length through a buckle 27, and adjustment of the relative length of the front strap 21 is effected by means of a pair of buckles 30. These buckles, and the manner in which they are used to adjust the relative lengths of the straps 20 and 21, are similar to buckles typically used for belts, harnesses, and the like.

To secure the saddle seat-encircling loop comprised of the straps 20 and 21 onto the saddle 10, the rear portion of the strap 20 extends under and behind the cantle 14 of the saddle and wedges behind the cantle 14 when the auxiliary stirrup assembly is in use. The front strap 21 then is secured to the pommel 15 and horn 16 of the saddle. This is accomplished through an attachment ring 33, secured to the center front of the strap 21, and a pair of auxiliary straps 35 and 36 attached at spaced points on opposite sides of the ring 33. These straps 35 and 36 are connected together to terminate in a single strap extension 38, having a snap hook 39 attached to its free end through an adjustment buckle 40 for engagement in the ring 33. The horn 16 of the adult saddle 10 extends upwardly through the opening formed between the straps 35 and 36. The strap extension 38 then extends downwardly on the side of the horn 16 facing the seat 12 of the saddle where the extension 38 and the snap hook 39 are passed through the opening under the horn 16 to attach to the ring 33. Proper adjustment of the length of the loop which is formed by the straps 35, 36 and 38 is effected by means of the adjusting buckle 40 to cause this connection to be a snug connection on the saddle 10 on which the auxiliary stirrup assembly is used.

The stirrup assembly then is completed by connecting a pair of child-sized or small-sized stirrups 46 (one on each side) to each of the rings 25, respectively, through adjustable stirrup support straps 49. The length of the straps 49 may be adjusted by means of a buckle adjustment 51 to cause the stirrups 46 to be located a suitable distance beneath the rings 25 for the particular child or youth who is going to use the assembly to ride the horse. Suitable keepers are provided for the ends of the various straps which are adjusted by means of the buckles 27, 30, and 51 to provide a smooth appearance and to prevent the strap ends from becoming entangled with the clothing of the rider.

The various adjustments which have been described above in conjunction with the different buckles and straps permit a front-to-rear adjustment of the location of the stirrups 46 to be effected relative to the seat 12 of the saddle on which the auxiliary stirrup assembly is mounted. This is accomplished by making the relative adjustments in the lengths of the front strap 21 and rear strap 20 by means of the buckles 27 and 30. In addition, it also is readily apparent that a relatively wide range of vertical adjustments of the stirrups 46 is possible by means of the buckles 51 provided on the looped straps 49, used to support the stirrups 46 from the rings 25. As a consequence, the auxiliary stirrup assembly may be properly positioned on the saddle 10 to accommodate riders of various ages and sizes in a correct riding position on the saddle 10.

By use of this auxiliary stirrup assembly, a young rider may ride the horse unaccompanied by an adult. The strap 20 wedges behind the cantle 14 to minimize side-to-side slippage of that strap; and the straps 35, 36 and 38, in conjunction with the ring 33 and snap hook 39, firmly secure the front strap 21 to the pommel of the saddle 10 to prevent side-to-side movement thereof. It also is apparent from an examination of the embodiment shown in the drawing that the arrangement is secure from front to rear, while at the same time providing normal movement of the stirrups 46 for the rider using the assembly. In addition, it should be noted that no saddle straps or other portions of the stirrup assembly cross over the seat 12 of the saddle 10 in the area which is contacted by the rider. As a consequence, the stirrup assembly is confortable to a rider using the assembly. In fact, the auxiliary stirrup assembly, which is illustrated in the drawing and which has been described above, functions from a rider's standpoint in the same manner as a much more expensive, scaled-down or small-sized "youth saddle" of the type which is quickly outgrown by a youthful rider.

The auxiliary stirrup assembly may be used on adult saddles 10 of various sizes and readily is slipped on and off of such a saddle. To remove the assembly from an adult saddle 10, the snap fastener 39 is disengaged from the loop 33, and the strap 21 then is raised upward over the horn 16. The rear strap 20 then may be pulled to the rear of the cantle 14 until it clears the cantle. The entire assembly then may be removed for storage. Since all of the straps are relatively thin and are not bulky, the stirrup accessory is easy to handle and store.

Although the straps 20, 21 and 49 may be made of a variety of materials, a highly suitable strap comprises flat nylon webbing, approximately 1" in width, of the type typically used in seat belt harnesses and the like. This material is very flexible and lays flat against the saddle with minimum discomfort to the rider. The various straps could be made of leather but the leather does not lay against the saddle 10 nearly as well as the nylon webbing, which is the preferred material.

Various changes and modifications will occur to those skilled in the art; so that the embodiment which is illustrated in the drawing, and which has been described above, is to be considered as illustrative only and not as limiting. In addition to the use of different materials for the straps, different means for adjusting the relative lengths of the straps other than the buckles which have been shown may be employed. For example, snap connections, hook-and-eye connections or the like may be employed without departing from the scope of the invention.

I claim:

1. An auxiliary stirrup assembly for use with a saddle having a seat, cantle, and pommel, including in combination:

strap means encircling the seat of the saddle and attached between the pommel and the cantle of the saddle;

attaching means for attaching said strap means to the pommel of the saddle, said attaching means securing said strap means against side-to-side shifting of said strap means with respect to the seat of said saddle, and said strap means extending behind the cantle of the saddle to thereby secure said strap means against front-to-rear shifting thereof and;

means for attaching an auxiliary stirrup to said strap means on each side of the seat of the saddle so that a child may sit on such seat and use said auxiliary stirrups.

2. The combination according to claim 1 further including means for adjusting the length of said strap means to permit said auxiliary stirrup assembly to be used with saddles of different sizes.

3. The combination according to claim 1 wherein said strap means and said means for attaching said auxiliary stirrups to said strap means are made of elongated nylon webbing.

4. The combination according to claim 1 wherein said means for attaching said auxiliary stirrups to said strap means comprises means for adjusting the distance between said auxiliary stirrups and said strap means.

5. The combination according to claim 4 wherein said strap means comprises at least a two-part strap with a first part having first and second ends, extending from the pommel of the saddle and terminating at a point on each side of the seat of the saddle and with the second part thereof having first and second ends, extending from behind the cantle of the saddle and terminating at the corresponding ends of the first part and wherein said means for attaching an auxiliary stirrup to said strap means interconnects the first end of said first part with the first end of said second part and the second end of said first part with the second end of said second part.

6. The combination according to claim 5 wherein said attaching means includes first and second rings to which the first ends and second ends of the first and second parts of said strap means are connected, respectively; and first and second adjustable stirrup strap means connected between said first and second rings, respectively, and said auxiliary stirrups.

7. The combination according to claim 6 wherein said first and second stirrup strap means have means for incrementally adjusting the distance between said first and second rings and the corresponding auxiliary stirrups attached thereto.

8. The combination according to claim 7 further including means for adjusting the length of said strap means to permit said auxiliary stirrup assembly to be used with saddles of different sizes.

9. The combination according to claim 8 wherein said strap means and said means for attaching said auxiliary stirrups to said strap means are made of elongated nylon webbing.

10. The combination according to claim 1 wherein said strap means comprises at least a two-part strap with a first part having first and second ends, extending from the pommel of the saddle and terminating at a point on each side of the seat of the saddle and with the second part thereof having first and second ends, extending from behind the cantle of the saddle and terminating at the corresponding ends of the first part and wherein said means for attaching an auxiliary stirrup to said strap means interconnects the first end of said first part with the first end of said second part and the second end of said first part with the second end of said second part.

11. The combination according to claim 10 further including means for adjusting the relative lengths of said first and second parts of said strap means to adjust the front-to-rear stirrup position relative to the seat of said saddle.

12. The combination according to claim 11 wherein said attaching means includes first and second rings to which the first ends and second ends of the first and second parts of said strap means are connected, respectively; and first and second adjustable stirrup strap means connected between said first and second rings, respectively, and said auxiliary stirrups.

13. The combination according to claim 12 wherein said strap means and said means for attaching said auxiliary stirrups to said strap means are made of elongated nylon webbing.

* * * * *